United States Patent [19]

Alexander

[11] 3,992,609

[45] Nov. 16, 1976

[54] SUPPORT MEMBER FOR ELECTRIC HEATING ASSEMBLY AND METHOD OF MANUFACTURING

[75] Inventor: Donald E. Alexander, Knoxville, Tenn.

[73] Assignee: Carrier Corporation, Syracuse, N.Y.

[22] Filed: June 30, 1975

[21] Appl. No.: 591,798

[52] U.S. Cl. ..... 219/532; 174/138 J; 219/536; 219/550; 338/317

[51] Int. Cl.[2] ..... H05B 3/06

[58] Field of Search ..... 219/532, 536, 550; 174/72 A, 138 J; 248/68 R, 73 R, 74 A; 338/213, 290, 304, 305, 315, 317, 318, 319, 321

[56] References Cited

UNITED STATES PATENTS

| | | | |
|---|---|---|---|
| 1,067,869 | 7/1913 | Falkenberg | 338/318 X |
| 1,188,972 | 6/1916 | Moffat | 174/138 J |
| 1,698,282 | 1/1929 | Simmons | 174/138 J |
| 3,009,044 | 11/1961 | Doehler | 219/532 |
| 3,302,003 | 1/1967 | Kinney | 219/550 |
| 3,846,619 | 11/1974 | Wightman et al. | 219/532 |

FOREIGN PATENTS OR APPLICATIONS

| | | | |
|---|---|---|---|
| 408,621 | 3/1970 | Australia | 248/73 |
| 643,842 | 6/1962 | Canada | 338/315 |
| 784,992 | 5/1935 | France | 219/535 |
| 6,816,455 | 5/1970 | Netherlands | 174/72 A |
| 87,714 | 5/1956 | Norway | 219/550 |

*Primary Examiner*—Volodymyr Y. Mayewsky
*Attorney, Agent, or Firm*—J. Raymond Curtin; Barry E. Deutsch

[57] ABSTRACT

A support member for an electric heating assembly of the type having a plurality of heating elements supported by electrical insulators. The support member comprises channel-like strips sized to receive the electrical insulators and includes tab-like portions integrally formed from at least one of the walls of the strip and lying across the opening of the channel defined by the strip. Adjacent ones of the tab-like portions lock the insulators in position on the support member.

1 Claim, 5 Drawing Figures

SUPPORT MEMBER FOR ELECTRIC HEATING ASSEMBLY AND METHOD OF MANUFACTURING

BACKGROUND OF THE INVENTION

This invention relates in general to electric heating assemblies, and more particularly, to a support member for the electrical insulators of the assembly, and to a method of manufacturing such support members.

Electric heating assemblies of the type having a resistance element connected to a source of electricity and mounted on suitable support structures including electrical insulators are used in various applications. Such assemblies may be used independently, for example to provide heat for a space or a room. Alternatively, such assemblies may be incorporated into a larger piece of equipment; for example, resistance heaters may be included in air conditioning units to provide warm air when required.

In order to insure the integrity of the assembly, it is essential that the insulators be firmly locked in position once located upon the support members of the assembly. In the prior art, the utilization of conventional fasteners, such as screws or rivets, has increased the material cost in providing an assembly, as well increased the manufacturing cost due to the necessary labor and/or machine tool operations involved in securing the fasteners. Heretofore, as an alternative to the utilization of conventional fasteners, the base of the insulators have been formed with grooves to lock the insulators on the support members. The foregoing is disclosed in U.S. Pat. No. 1,698,282. In order to utilize such alternative means, the insulators are rotated 90° so the grooves formed on the base may be brought into contact with tracks formed along the transversely extending edges of a support member. Such alternate to the utilization of conventional fasteners is more complicated than the invention to be described hereinafter.

SUMMARY OF THE INVENTION

Accordingly, it is an object of the invention to positively lock electrical insulators on a support member of an electric heating assembly.

It is a further object of the invention to firmly lock the insulators on the support member without utilizing conventional fasteners.

It is a further object of this invention to decrease the cost of providing an electric heating assembly.

It is yet another object of this invention to manufacture a support member for an electric heating assembly wherein the support member includes integral locking means to firmly secure the insulators on the support members.

These and other objects of the present invention are obtained by means of a support member for the heating elements of an electric heating assembly wherein the support member comprises a channel-like strip sized to receive electrical insulators employed to mount the heating elements. The channel-like strip further includes tab-like portions extending from at least one wall thereof and lying across the channel defined by the strip. Adjacent ones of the tab-like portions lock the insulators in position on the support member.

DESCRIPTION OF THE PREFERRED EMBODIMENT

Figure 2:
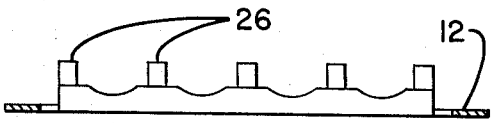
FIG. 2 is a plan view, partially in section, of a support member prior to the installation of electrical insulators thereon.

Referring now to the drawings, there is illustrated a preferred embodiment of the instant invention. In referring to the various figures of the drawings, like numerals shall refer to like parts.

Figure 1:
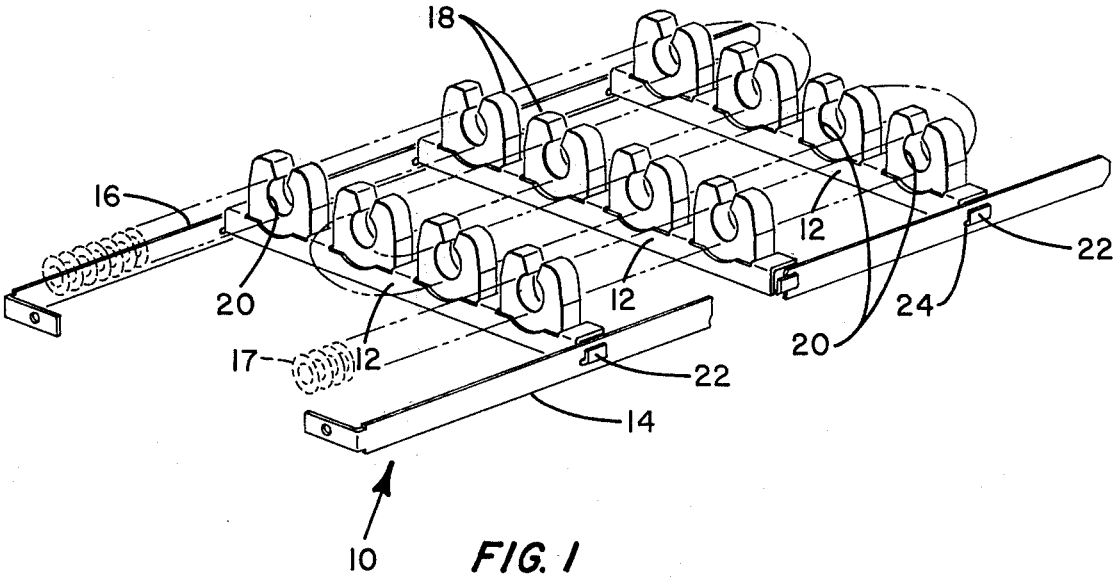
FIG. 1 is a perspective view illustrating an electric heating assembly support structure including the support members of the present invention.

With particular reference to FIG. 1, there is disclosed a support structure 10 for an electric heating assembly of the type to which the present invention pertains. Support structure 10 includes a plurality of U-shaped support members 12 extending between side supports 14 and 16. Electrical insulators 18 are mounted on support members 12 in a manner to be more fully explained hereinafter. Electrical insulators 18 are formed from a suitable non-conductive material. Typically, the electric resistance element 17 (shown in phantom) employed in heating assemblies of the type to which the present invention pertains is formed from a single piece of material which is suitably bent to provide a plurality of U-shaped sections. Each insulator includes a circular opening 20 to suitably support the heating element.

In order to connect support members 12 to side supports 14, 16, each end of the support members is provided with a tab 22. The side supports have suitable openings 24 for insertion of the tabs which are then crimped over in the manner shown in FIG. 1 to firmly connect the side supports to the support members.

As shown in FIG. 2, each channel-like support member 12 includes tab-like members or strips 26 extending vertically upwardly from at least one of the side walls forming the channel-like member. Tab-like members 26 are spaced equidistantly along the longitudinal axis of the channel-like support member.

Figure 4:
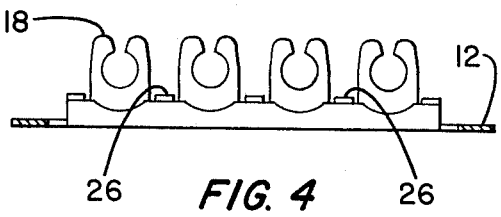
FIG. 4 is a view similar to FIGS. 2 and 3 illustrating the electrical insulators firmly locked in position on the support member of the present invention.
Figure 5:
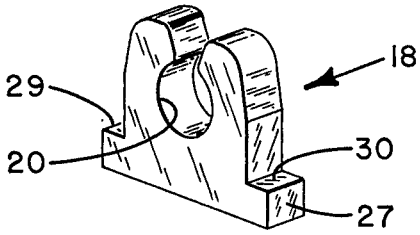
FIG. 5 is a perspective view of an electrical insulator particularly suitable for mountng on the support member of the present invention.

At a work station, the insulators 18 are inserted between the opposed walls of the channel-like members. The width of the channel-like members is slightly larger than the width of the electrical insulators to permit such members to be readily inserted between the opposed walls. As shown in FIG. 5, each insulating member is shaped in the form of an inverted tee. The end portions 27, 29 of each member abut with the end portions of the insulating members on either side thereof; the outer end portions of the outer insulating members are in contact with the inner surfaces of side support members 14, 16. Additionally, as shown in FIG. 4, the end portions 27, 29 of insulating members 18 lie generally co-planar with the top edges of the opposed walls of the channel-like support members. The width of each of the tab-like portions 26 is generally equal to the width of adjacent end portions 27, 29 of insulator members 18.

Figure 3:
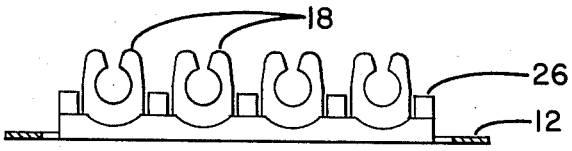
FIG. 3 is a view similar to FIG. 2 showing the support member having the electrical insulators placed thereon.

After insulator members 18 are loaded onto channel-like support members 12 as shown in FIG. 3, tab-like portions 26 are bent downwardly to lie in a horizontal plane across the opening of the channel-like members to firmly secure the insulating member in place. The foregoing is clearly shown in FIGS. 1 and 4. As is illustrated therein, consecutive ones of the tab-like strips capture an insulating block therebetween to prevent insulating members 18 from being accidentally dislocated from the support members therefor.

The utilization of the tab-like portions which are provided integral with support members 12 eliminates the need for employing conventional fasteners to lock the insulating members in place on the support strips. The elimination of conventional fasteners reduces the material and manufacturing cost of providing an electric heating assembly.

It should be understood, that although the tab-like portions are shown as extending from only one wall of the channel-like member, it should be understood that such tab-like portions may alternately extend from both walls of the channel-like member.

While a preferred embodiment of the present invention has been described and illustrated, the invention should not be limited thereto, but may be otherwise embodied within the scope of the following claims.

I claim:

1. In an electric heating assembly of the type having a plurality of electrical heating elements supported by electrical insulators shaped in the form of an inverted tee and having substantially circular openings supporting the electrical heating elements, an electrical insulator support comprising:

a channel shaped support structure with a channel sized to slidably receive electrical insulators and including a plurality of tab-like strips integrally extending from at least one side of the channel-like structure in axially spaced apart relation, the width of said tab-like strips being substantially equal to the width of adjacent ends of the tee-like electrical insulators, said strips lying in a horizontal plane in intimate contact with said adjacent ends of said tee-like insulators to lock said insulating members in position on said support structure.

* * * * *